US009328613B2

(12) United States Patent
Lehmann

(10) Patent No.: US 9,328,613 B2
(45) Date of Patent: May 3, 2016

(54) PROPELLER ARRANGEMENT, IN PARTICULAR FOR WATERCRAFT

(71) Applicant: Becker Marine Systems GmbH & Co., KG, Hamburg (DE)

(72) Inventor: Dirk Lehmann, Winsen/Luhe (DE)

(73) Assignee: Becker Marine Systems GmbH & Co KG, Hamburg (DE)

( * ) Notice: Subject to any disclaimer, the term of this patent is extended or adjusted under 35 U.S.C. 154(b) by 0 days.

(21) Appl. No.: 13/674,186

(22) Filed: Nov. 12, 2012

(65) Prior Publication Data

US 2013/0129514 A1 May 23, 2013

(30) Foreign Application Priority Data

Nov. 18, 2011 (DE) ..... 10 2011 055 515
Nov. 6, 2012 (EP) ..... 12191460

(51) Int. Cl.

| | |
|---|---|
| ***B63H 1/26*** | (2006.01) |
| ***F01D 5/14*** | (2006.01) |
| ***B63H 1/28*** | (2006.01) |
| ***B63H 5/10*** | (2006.01) |

(52) U.S. Cl.

CPC .. *F01D 5/14* (2013.01); *B63H 1/28* (2013.01); *B63H 5/10* (2013.01); *B63H 2001/283* (2013.01)

(58) Field of Classification Search

CPC ..... B63H 1/28; F01D 5/14
USPC ..... 415/62, 66, 68; 416/120, 124, 125, 416/198 R, 201 R, 201 A, 198 A, 244 B
See application file for complete search history.

(56) References Cited

U.S. PATENT DOCUMENTS

| | | | | | |
|---|---|---|---|---|---|
| 463,322 | A | * | 11/1891 | Sparr et al. | 416/200 R |
| 599,125 | A | * | 2/1898 | Fefel | 416/129 |
| 968,823 | A | * | 8/1910 | Westinghouse | 440/49 |
| 1,607,116 | A | * | 11/1926 | Checkley | 416/201 R |
| 1,717,663 | A | * | 6/1929 | Checkley | 416/200 R |
| 1,813,552 | A | * | 7/1931 | Stechauner | 416/129 |
| 3,549,271 | A | * | 12/1970 | Hidetsugu | 416/124 |
| 3,606,579 | A | * | 9/1971 | Mehus | 416/200 R |
| 4,473,308 | A | * | 9/1984 | Kramer | 384/98 |
| 4,604,032 | A | * | 8/1986 | Brandt et al. | 416/128 |
| 4,623,299 | A | * | 11/1986 | Grim | 416/124 |
| 4,767,269 | A | * | 8/1988 | Brandt | 416/124 |
| 5,096,383 | A | * | 3/1992 | Dobrzynski | 416/200 R |

(Continued)

FOREIGN PATENT DOCUMENTS

| | | | |
|---|---|---|---|
| CN | 1031975 | A | 3/1989 |
| DE | 606119 | C | 11/1934 |

(Continued)

OTHER PUBLICATIONS

Office Action dated Jul. 28, 2014 for Korean application No. 10-2012-0129803.

(Continued)

*Primary Examiner* — Craig Kim
*Assistant Examiner* — Kayla McCaffrey
(74) *Attorney, Agent, or Firm* — Kelly & Kelley, LLP

(57) ABSTRACT

A drive system of a watercraft includes a propeller rotatable about a propeller axis, and at least one rotor fin which is disposed freely rotatably about the propeller axis. The diameter of a circular path described by the rotation of the at least one rotor fin is less than the diameter of the propeller.

21 Claims, 5 Drawing Sheets

(56) References Cited

U.S. PATENT DOCUMENTS

| | | | | | |
|---|---|---|---|---|---|
| 5,161,369 | A * | 11/1992 | Williams | 60/226.1 | |
| 5,480,330 | A * | 1/1996 | Brown | B63H 11/08 | 440/38 |
| 7,407,366 | B2 * | 8/2008 | Hedlund | B63H 5/10 | 415/124 |
| 7,806,661 | B2 * | 10/2010 | Duffield | 416/176 | |

FOREIGN PATENT DOCUMENTS

| | | | |
|---|---|---|---|
| DE | 3508203 | A1 | 9/1986 |
| DE | 101 52 977 | C1 | 5/2003 |
| EP | 0255136 | A1 * | 2/1988 |
| EP | 0 406 451 | A1 | 1/1991 |
| EP | 0 758 606 | A1 | 2/1997 |
| FR | 2573722 | A1 | 5/1986 |
| GB | 2160618 | A | 12/1985 |
| JP | 58-183382 | A | 10/1983 |
| JP | S61-135798 | U | 8/1986 |
| JP | 62-103295 | A | 5/1987 |
| JP | H1-311982 | A | 12/1989 |
| JP | 02-279490 | A | 11/1990 |
| JP | H8-282590 | A | 10/1996 |
| JP | 2002-166888 | A | 6/2002 |
| JP | 2009-51283 | A | 3/2009 |
| WO | 2010/044966 | A2 | 4/2010 |
| WO | WO 2010044966 | A2 * | 4/2010 |

OTHER PUBLICATIONS

First Office Action for Chinese application No. 2012104694898.

* cited by examiner

PROPELLER ARRANGEMENT, IN PARTICULAR FOR WATERCRAFT

The invention relates to a propeller arrangement, in particular for a drive system of a watercraft, for example, a ship, comprising a propeller that is rotatable about a propeller axis.

Most watercraft comprise a drive system which comprises a propeller that is rotatable about a propeller axis. When the water flows through the propeller surface spanned by the rotating propeller, it is accelerated and twisted. As a result, turbulence can occur in the propeller backwash. It is generally known that this turbulence is usually particularly high in the area of the hub or downstream of the hub when viewed in the direction of travel of the ship. This turbulence is also known as "hub vortex" and has a negative effect on the drive power.

In order to reduce the hub vortex and thus increase the efficiency of the propeller, it has been proposed, for example, in EP 0 255 136 A1 to provide fixed fins or flow guiding fins on the hub cap disposed downstream of the propeller in the direction of travel of the ship, i.e. in the propeller hub end region, which fins are firmly connected to the propeller hub and co-rotate with this. The radial extension of the fins is substantially restricted to the hub region. By providing these fixed fins on the hub cap which co-rotate with the propeller, a weakening of the hub vortex and therefore an improvement in the drive power of the propeller can be achieved.

It is now the object of the present invention to provide a propeller arrangements with which the hub vortex can be further reduced and the efficiency therefore further improved.

This object is solved with a propeller arrangement, in particular for a drive system of a watercraft, comprising a propeller that is rotatable about a propeller axis, where at least one rotor fin is further provided. The rotor fin is expediently configured to be blade-like and disposed freely rotatably about the propeller axis. Accordingly, the rotor fin is configured to be freely rotating or driveless, i.e. it has no separate drive for the rotation about the propeller axis but is optionally driven by the respectively prevailing ambient conditions, in particular by the prevailing water flow, for rotation about the propeller axis. Expediently the at least one rotor fin is disposed on the propeller backwash side, i.e. in the backwash of the (ship's) propeller. In other words, the at least one rotor fin is located downstream of the propeller in the direction of travel of the ship. It is thus achieved that the backwash of the propeller impinges upon the at least one rotor fin and this is expediently configured in such a manner that it is thereby set in rotation.

The rotor fin is configured such that it influences the propeller backwash in such a manner that the vortex formation in the region of the hub, i.e. the so-called hub vortex is reduced. This can be achieved, for example, whereby the rotor fin generates a counter-twist with respect to the twisting applied by the propeller in the flow in the region of the hub, which then results overall in a homogenisation of the propeller flow in the hub region and consequently in a laminar flow. This effect is achieved in particular due to the freely rotatable configuration of the rotor fin. Compared with the fins known from the prior art, which are attached firmly on the hub cap and necessarily co-rotate with the propeller, the freely rotatable fin according to the invention has a variable rotational speed which depends on the configuration of the mounting and the inflow, for example, speed of the inflow, degree of twisting etc. An improved flow pattern of the propeller backwash is thereby established in the region of the hub and therefore a better overall efficiency. As a result, the overall drive power of the propeller is permanently improved. Usually the rotational speed of the freely rotating at least one rotor fin will be lower than that of the propeller. However, this need not necessarily be the case in every operating state.

Since the at least one rotor fin is intended to substantially exclusively influence the propeller flow in the hub region, it is further provided that the diameter of a circular path described by the rotation of the at least one rotor fin is smaller than the diameter of the propeller. The circular path is here described by the outermost tip of the rotor fin, when viewed in the radial direction from the propeller axis. This merely conceptually formed circular path is produced by one complete revolution of the rotor fin. In other words, the rotor fin surface spanned by the at least one rotor fin during a complete revolution is smaller than or has a smaller diameter than the propeller surface spanned by the propeller. Accordingly, the length of the rotor fin is shorter than the length of the propeller blades. The restriction to a smaller rotor fin diameter than the propeller diameter has the result that the influence on the propeller backwash is substantially concentrated on the hub region and possibly undesirable and disadvantageous influences on the propeller backwash do not occur in other regions. In this connection, it is particularly advantageous that the diameter of the circular path of the at least one rotor fin is less than 75%, particularly less than 55% and in particular less than 35% of the diameter of the propeller. If the diameter of the rotor fin were larger and therefore the individual rotor fin blades were larger when viewed in the radial direction, a negative influence on the propeller flow could possibly occur and strength problems could arise at the at least one rotor fin.

The rotor fin can in principle be made of any suitable material. Preferably stainless steel or another suitable material is used to manufacture the rotor fin. In principle, any flow guiding body which is configured to actively influence the flow in a not-insignificant manner can be used as rotor fin. In particular, it is expedient to configure the rotor fin to be blade-like or fin-like. For example, the rotor fin can be configured in the form of a guide fin. Furthermore, the rotor fin can be configured with or without a hydrofoil profile. When formed with a hydrofoil profile, the fin has a pressure side and a suction side, where the suction side is then in particular curved outwards in a circular arc shape and the pressure side can be configured to be substantially flat. In principle, however, a plate-shaped configuration having a substantially flat profile on both sides or a curved configuration on both fin sides is also possible. The profile of the rotor fin can furthermore be uniform or different when viewed over its length. In particular, the profile of the rotor fin can be turned into itself, i.e. twisted, when viewed in the longitudinal direction of the fin.

It is further preferred that the at least one rotor fin has one free end. The end of the rotor fin opposite the free end is in this case expediently fastened on a pivot bearing which enables rotation about the propeller axis. The free end is therefore usually furthest away from the propeller axis when viewed in the radial direction from the propeller axis. The term "free end" is to be understood such that this end region of the rotor fin is not fastened on another component. In particular it is preferred that no nozzle or turbine ring is provided around the free end region of the rotor fin, i.e. the at least one rotor fin is not disposed inside a nozzle or turbine ring.

The propeller arrangement according to the invention is in particular suited for fixed propellers. The term "fixed propeller" is understood in the present case to be those propellers which are indeed rotatable about the propeller axis but are not pivotable about a rudder axis for steering the watercraft.

Expediently the at least one rotor fin is disposed on or in the region of the propeller hub of the propeller. Usually the at least one rotor fin is also mounted on the hub so that it is fixed freely rotatably on the hub. Alternatively the at least one rotor fin can also be disposed on a component placed on the hub, for example, a separate hub end piece or similar. In particular, it is expedient that the rotor fin is disposed in the region of the (free) hub end.

In a preferred embodiment, in addition to the at least one freely rotatable rotor fin, at least one stator fin co-rotating with the propeller is provided. Expediently the at least one stator fin is disposed between the freely rotatable rotor fin and the propeller. Accordingly, in a preferred embodiment, the at least one stator fin is disposed in the axial direction downstream of the propeller and in turn the at least one rotor fin is disposed downstream of the at least one stator fin. The term "co-rotating" is to be understood in the present case such that the stator fin necessarily rotates in common mode with the propeller, i.e. at the same speed and frequency. Expediently, the stator fin is therefore directly connected to the propeller or to the propeller hub. It is advantageous here that as a result of a corresponding configuration of the stator fin in relation to its shape and angle of attack, a certain untwisting of the propeller flow is achieved in the area of the hub region, before the flow impinges upon the rotor fin which is driven by said flow and the flow is thereby further laminarised or untwisted.

The at least one stator fin comprises a fin, i.e. a guide fin for non-insignificant influencing of the flow. With regard to its material, its shape or other geometrical configuration, it can advantageously also be configured as described hereinbefore for the rotor fin. In particular, as with the rotor fin, it is expedient that the length of the fin or fin blade of the at least one stator fin is not longer than the length of the propeller blade. In particular, a circular path described by the stator fin during rotation can therefore have a smaller diameter than the diameter of the propeller. The circular path of the stator fin is preferably less than 75%, particularly preferably less than 55%, in particular less than 35% of the diameter of the propeller. Also the length of the stator fin can correspond to the length of the rotor fin—in each when viewed in the radial direction. In addition, other dimensioning and configuration aspects such as the angle of attack or the depth of the fin in the axial direction can be similar or the same as the rotor fin or even different from this.

In a further preferred embodiment, the at least one stator fin is arranged offset by an angle with respect to the propeller blades of the propeller when viewed in the axial direction. Consequently, when viewed over the circumference of the propeller hub, the stator fin is attached at different positions on the propeller hub than the propeller blades. If several stator fins are provided, advantageously all the stator fins should be arranged offset to the propeller blades and particularly preferably each at the same distance. As a result of the offset arrangement a more favourable hydrodynamic efficiency is achieved. Advantageously the stator fin is arranged in such a manner that when viewed in the circumferential direction, it is disposed approximately centrally between two propeller blades. "Approximately centrally" should be understood in the present case such that the stator fin when viewed in the circumferential direction is located on the distance from one propeller blade to the other propeller blade (in each case when viewed from the propeller blade central point) in the range between 25% and 75% of the total distance, preferably in the range between 35% and 65% of the total distance (in each case taking the central point of the stator fin as the basis).

In a preferred embodiment, a number of rotor fins and/or a number of stator fins are provided. In this exemplary embodiment the plurality of rotor fins and the plurality of stator fins are expediently arranged in the axial direction at the same height and distributed over the circumference. The distribution over the circumference is particularly preferably uniform, i.e. at equal distances. Expediently the rotor fins and/or the stator fins can each be configured to be the same in relation to their configuration (shape, size, material etc.). In principle, the number of rotor fins and/or of stator fins is not limited. Preferably two to seven rotor fins and/or stator fins, particularly preferably three to five rotor fins and/or stator fins are provided. In particular, the stator fins and/or the rotor fins can each have a same length. Further advantageously the number of rotor fins and/or stator fins can correspond to the number of propeller blades. In particular, when providing the same number of stator fins and propeller blades, it is preferred to arrange the stator fins offset to the propeller blades, where when viewed in the axial direction, in each case one stator fin is then disposed between two propeller blades. Particularly advantageously in this arrangement, the respective subregion of a propeller blade on the turbulent backwash of the propeller is in each case assigned to a stator so that a particularly efficient adjustment or alignment of the stator fin can then be made.

In a further preferred embodiment, the at least one rotor fin and/or the at least one stator fin is disposed at an angle of attack in relation to the propeller axis. The angle of attack is included for example between a longitudinal axis of the fin in a cross-sectional view and the propeller axis or a parallel to the propeller axis. The individual rotor fins and/or stator fins can each have the same or different angles of attack. It is also possible to arrange all the rotor fins with a predefined angle of attack and all the stator fins with a different predefined angle of attack. The adjustment of the stator fins and the rotor fins is preferably accomplished in the same direction, for example, both to port or both to starboard. It can also be preferred that one propeller blade is adjusted in the same direction as the stator fins and/or the rotor fins. The stator fins and/or the rotor fins can also have the same angle of attack as the propeller blades or different from this. If the individual rotor fins and/or stator fins are configured to be turned into themselves or twisted, different angles of attack for the individual fins are also obtained in sections. In particular, the angle of attack can be between 10° and 80°, preferably 25° to 70°, particularly preferably 40° to 60°. The stator fins and/or the rotor fins are preferably arranged fixed with respect to their angle of attack. In principle, an adjustable arrangement which allows an adjustment of the angle of attack is, however, also feasible. By providing an angle of attack, a specific influencing of the flow and therefore a particularly efficient untwisting can thus be achieved in a simple manner. The optimal angles of attack can vary from one propeller arrangement to another depending on the particular circumstances (e.g. propeller size, propeller speed, propeller blade profile etc.).

Expediently the at least one rotor fin and/or the at least one stator fin run radially to the propeller axis.

In a preferred embodiment a stator body is provided which is disposed on the front end side, i.e. at the free end, on the propeller hub of the propeller and is firmly connected to the propeller hub. The at least one stator fin is disposed on this stator body and is expediently also fastened to this. The at least one stator fin and the stator body can be formed as a one-piece unit. The manufacture of the propeller arrangement is simplified as a result since the stator fins need not be design in one piece or monolithically with the propeller hub, but manufactured as a separate component and should only be connected to the propeller hub by means of suitable connecting means such as, for example, bolts. This also provides the possibility for a relatively simple retrofitting.

The bearing for the at least one rotor fin is expediently configured to be water-lubricated. Accordingly it is not oil-lubricated and also not configured to be closed or sealed. This has the advantage that no complex lubrication/sealing system needs to be provided which reduces the manufacturing and maintenance expenditure of the bearing. Furthermore, the bearing is preferably configured as a combined axial and radial bearing. In principle, however the provision of two or more separate bearings for mounting the rotor fin in the radial and axial direction is also possible.

The bearing is preferably configured as a friction bearing and provided on the propeller hub or on the stator body. Particularly preferably the bearing can be configured to be self-lubricating. Self-lubrication bearings are also called "dry friction bearings" since dry friction generally occurs at these. This is caused by a self-lubricating property of one of the bearing partners or one of the two bearing elements. These bearings manage without additional lubrication or lubricants since solid lubricants are provided embedded in the material they are manufactured from, whereby the solid lubricants, as a result of microwear during operation, reach the surface and consequently reduce friction and wear. Expediently one of the two bearing elements movable with respect to one another is made of plastic or plastic composite and/or of ceramic structural materials to form the self-lubricating bearing. Preferably a part of the bearing or one of the bearing elements of the bearing can be formed from PTFE or ACM. The use of graphite-containing materials is also possible. The other bearing part or the bearing partner is preferably formed from metal, for example, bronze or brass. By this means the structure of the bearing is simplified since no additional means need to be provided to provide a lubricating film or the like and no external lubricants need be provided. From ecological aspects, this is also advantageous since no lubricants, for example grease, can enter into the sea from the bearing. The movable second bearing part or bearing partner can preferably be configured as a bearing ring, in particular a bronze ring, where the at least one rotor fin is expediently firmly attached to this second bearing element.

In a further preferred embodiment, the at least one rotor fin is disposed in the axial direction at a short distance from the propeller. In particular the distance can be a maximum of 0.8 times the propeller diameter, preferably a maximum of 0.5 times the propeller diameter, particularly preferably a maximum of 0.3 times the propeller diameter. In the present details, the measurement should be made in each case from the central point of the propeller or the at least one rotor fin. Optionally an arrangement can be provided at a distance of 0.2 times the propeller diameter or less. Expediently the arrangement of the at least one rotor fin can be provided at a short distance from the propeller on the backwash side of the propeller.

The propeller arrangement according to the invention will be explained in detail hereinafter with reference to an exemplary embodiment shown in the drawing. In the figures schematically:

Figure 1:
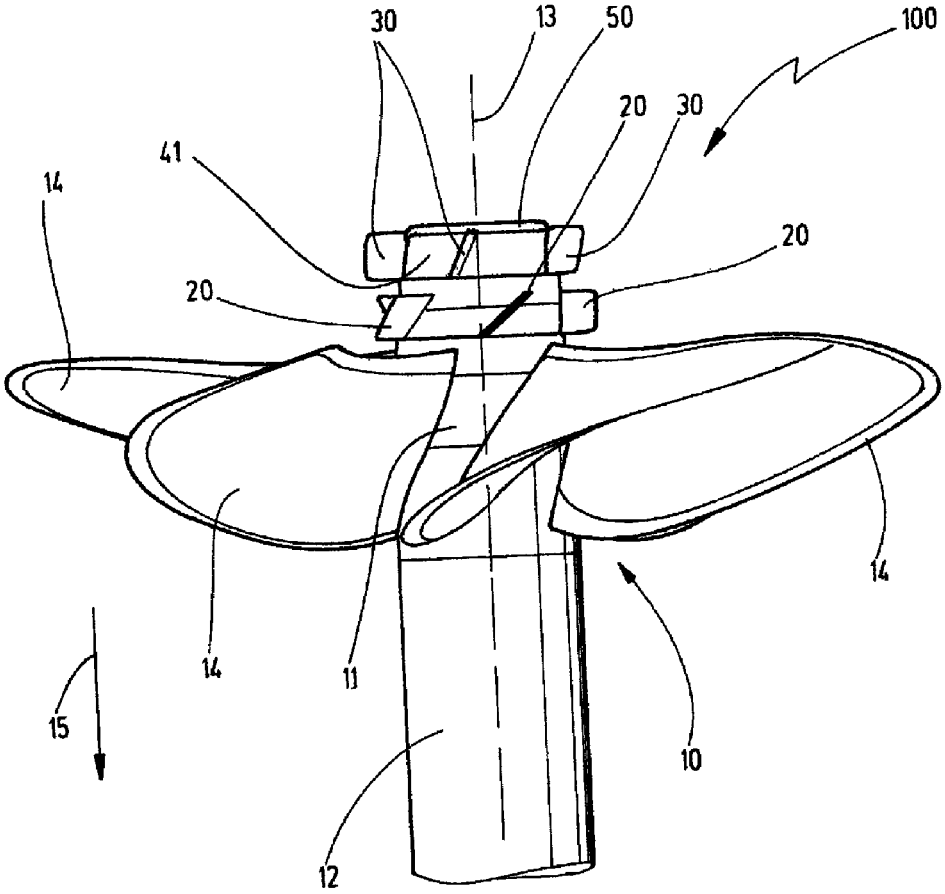
FIG. 1 shows a side view of a propeller arrangement.
Figure 2:
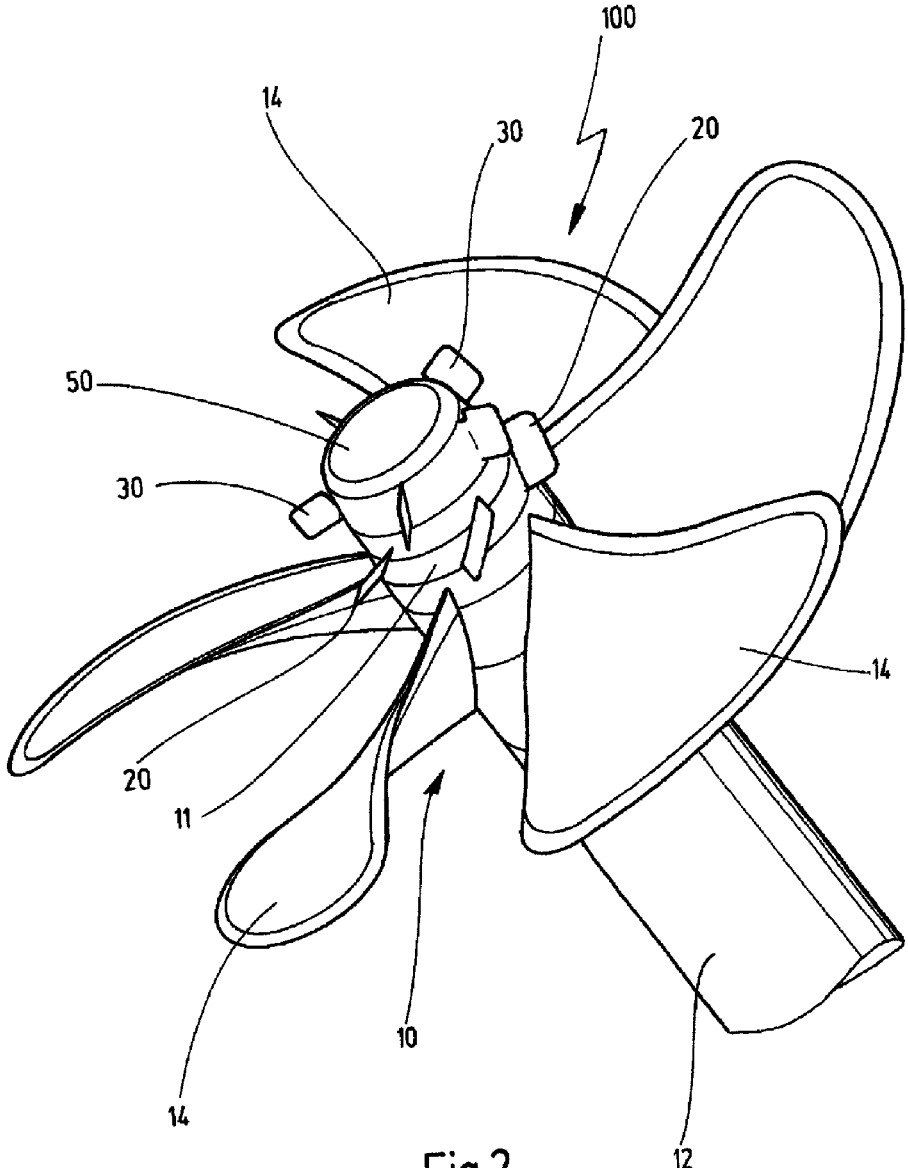
FIG. 2 shows a perspective view of the propeller arrangement from FIG. 1.
Figure 3:
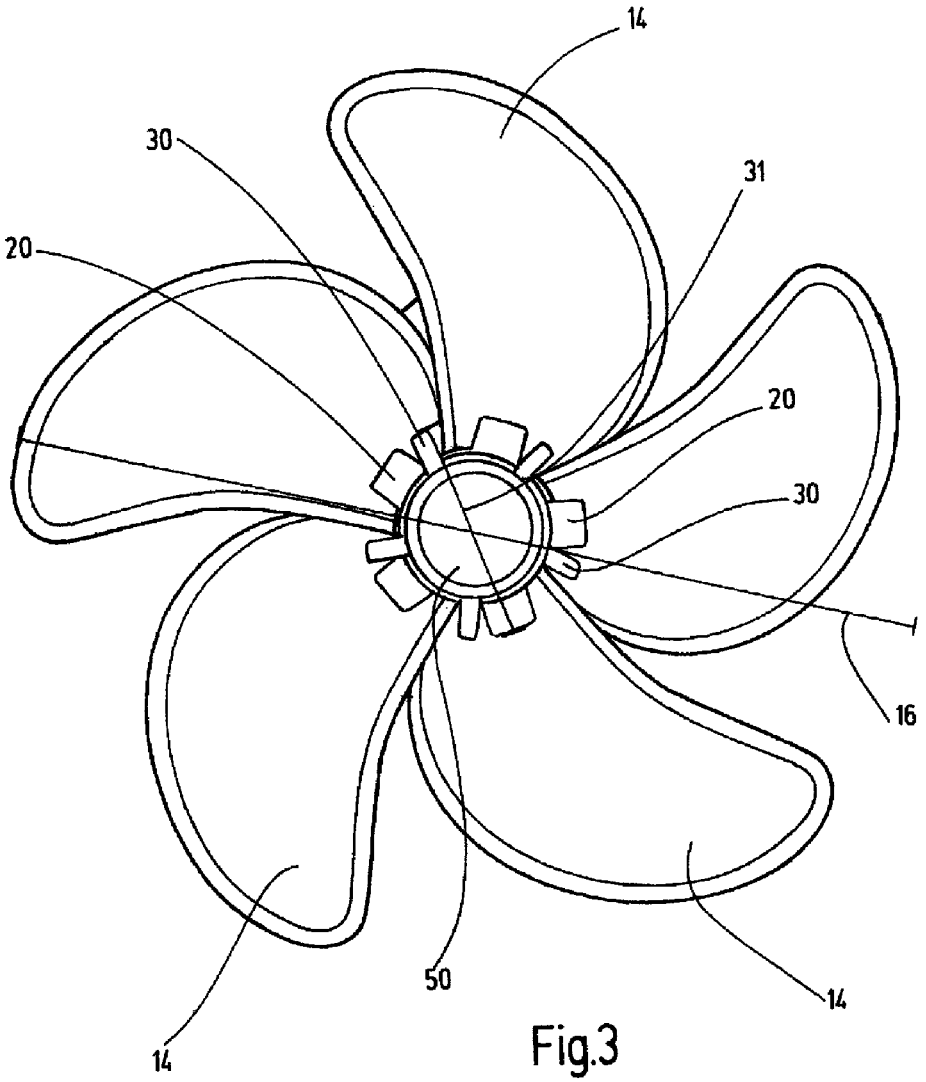
FIG. 3 shows a frontal view of the propeller arrangement from FIG. 1.

FIGS. 1 to 3 shows a propeller arrangement 100 according to the invention in each case in a side view, a perspective view and a frontal view. The propeller arrangement 100 comprises a ship's propeller 10 which comprises a propeller hub 11 which is firmly connected to a propeller shaft (not shown here). The propeller shaft runs along a propeller axis 13. The propeller shaft is mounted in a shaft bearing 12 that is configured as a stern tube in the present case. The propeller hub 11 is disposed at the end on the shaft bearing 12. Five propeller blades 14 project from the propeller hub 11 in the radial direction to the propeller axis 13. The propeller blades 14 are arranged uniformly distributed when viewed over the circumference of the propeller hub 11. Furthermore, the propeller blades 14 each have an angle of attack to the propeller axis 13, where the propeller blades 14 are turned into themselves or twisted over their length when viewed in the radial direction so that different angles of attack prevail according to the section of the propeller blade 14. However, the shape of the individual propeller blades 14 is the same in each case. Five stator fins 20 are disposed downstream of the propeller 10 when viewed in the direction of travel of the ship 15. The term "direction of travel of the ship" is to be understood in the present case as the direction of travel of the ship or watercraft when travelling forward. The stator fins 20 are disposed on a stator body 21 (see FIG. 4) which in turn is firmly connected to the propeller hub 11. Accordingly, the stator fins 20 turn during rotation of the propeller shaft with the propeller hub 11 and therefore necessarily with the propeller 10. The stator fins 20 are formed as flat, plate-like (fin) bodies substantially on both fin sides. The stator fins 20 have an angle of attack with respect to the propeller axis 13. This angle of attack is about 45°. The angle of attack of the stator fins is greater than the average angle of attack of the propeller blades.

When viewed in the direction of travel of the ship 15, five rotor fins 30 are further provided downstream of the stator fins 20. The rotor fins 30 are firmly attached to a bearing ring 41 of a friction bearing 40 (see in particular FIG. 4). The rotor fins 30 are arranged distributed at a uniform distance around the bearing ring 41 and are freely rotatable about the propeller axis 13. The rotor fins 30 are also configured as plate-shaped guiding or fin bodies provided with flat sides, which have an angle of attack to the propeller axis 13. The angle of attack has the same direction as that of the stator fins 20 or the propeller blades 14 but the angle of attack of the rotor fins 30 has a smaller value than the angle of attack of the stator fins 20 or of the propeller blades 14. The individual rotor fins 30 are configured to be the same in relation to their shape and their angle of attack. Both the rotor fins 30 and the stator fins 20 are made of stainless steel. The bearing ring 41 consists of bronze. It can be seen from FIG. 3 in particular that the radial length of the stator fins 20 and the rotor fins 30 is approximately the same and the length of one fin 20, 30 is only about 10% to 20%, in particular 15% of the length of a propeller blade 14. The diameter 31 of the circular path described by the rotation of the rotor fin 30 is accordingly very much smaller than the diameter 16 of the propeller 10. In particular the diameter 31 of the rotor fins 30 is only about 25% of the diameter 16 of the propeller 10. The diameter 31 of the rotor fins 30 approximately corresponds to the diameter of a circular path described by the stator fins 20 as a result of the similar radial lengths. The individual stator fins 20 are each arranged in the axial direction approximately directly downstream of a propeller blade 14.

Figure 4:
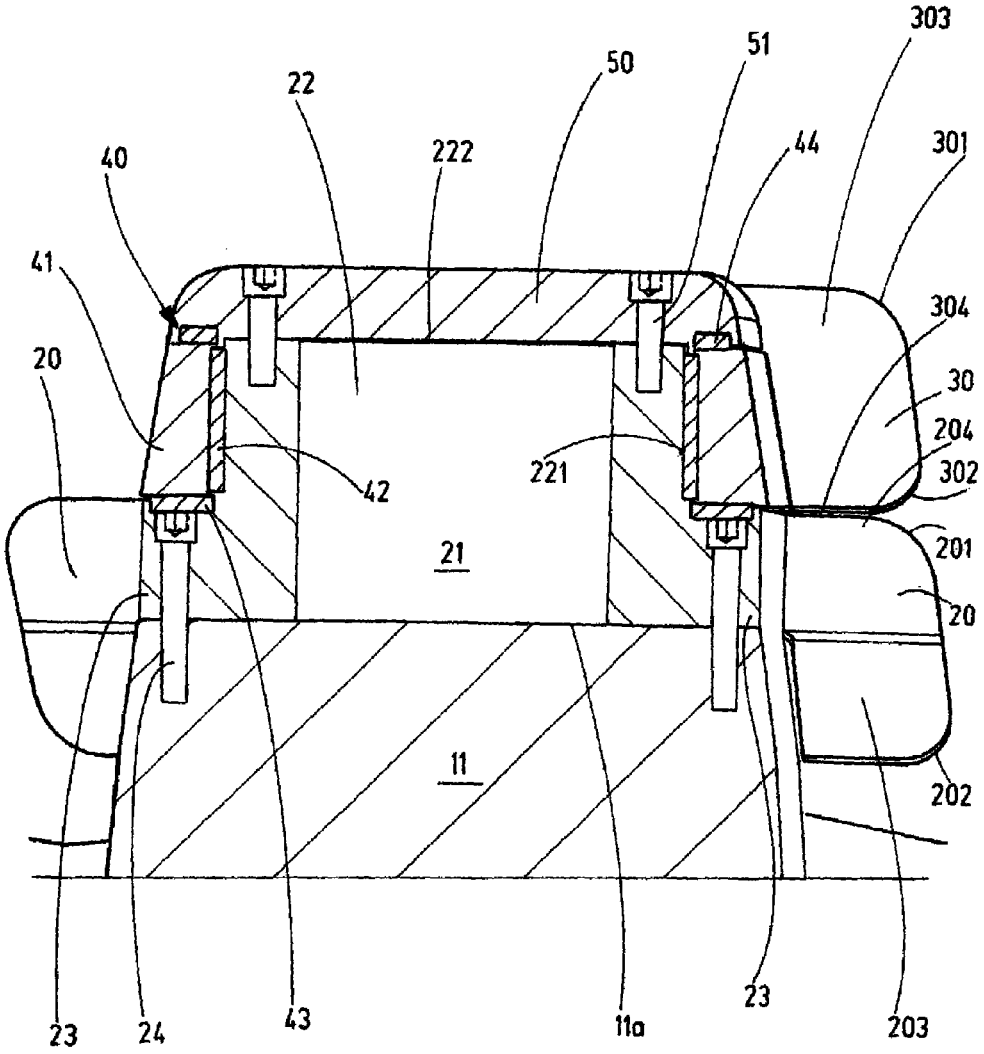
FIG. 4 shows a sectional view through a part of the propeller arrangement from FIG. 1.

FIG. 4 shows a sectional view through the rear part of the propeller arrangement 100 viewed in the direction of travel of the ship 15. A stator body 21 is placed on the front-side end region 11*a* of the propeller hub 11. The stator body 21 has a similar diameter to that of the propeller hub 11 in the area of the connection to the hub 11. In the further course in the axial direction, the stator body 21 has a tapering 22. This tapering is also configured cylindrically like the other region of the stator body 21. Thus, a stepped outer contour of the stator body 21 is obtained with an outer region 23 projecting laterally over the tapering region 22. Connecting means, i.e. bolts 24 are guided through this outer region 23, which connecting means extend into the propeller hub 11 and connect the stator body 21 firmly to the propeller hub 11. From this outer region 23 of the stator body 21 the stator fins 20 project radially outwards. These are preferably formed in one piece with the stator body 21. The stator fins 20 have a substantially rectangular outline where the two corner regions 201, 202 located remote from the hub 11 are configured to be rounded. A front subregion 203 of the stator fin 20 projects over a subregion of the propeller hub 11. Towards the other side (when viewed downstream in the axial direction), the stator fin 20 ends approximately flush with the outer region 23 of the stator body 21.

The tapering section 22 of the stator body 21 has a circumferential surface 221 and a front side surface 222. A bearing sleeve 42 consisting of plastic is attached firmly to the circumferential surface 221. The bearing ring 41 of the rotor fin 30, which is made of bronze, further lies on this bearing sleeve 42. The bearing sleeve 42 has self-lubricating properties so that overall a self-lubricating friction bearing 40 is obtained. The rotor fins 30 can rotate freely with the bearing ring 41 on the bearing sleeve 42. In the axial direction the bearing ring 41 is also bordered by two bearing rings 43, 44 also formed from a self-lubricating plastic material, which are aligned perpendicular to the propeller axis 13. The bearing ring 43 is in this case arranged fixedly on the front face of the outer region section 23 of the stator body 21. The bearing ring 44 on the other hand is arranged fixedly on an end cap 50, which in turn is fastened with bolts 51 to the tapering 22 of the stator body and abuts against the front side face 222. The friction bearing 40 thus consists of the bearing sleeve 42, the bearing ring 41 on which the rotor fins 30 are attached, as well as the two bearing rings 43, 44 aligned transversely to the propeller axis 13. The friction bearing 40 is therefore configured as a combined axial and radial bearing.

The rotor fins 30 have a substantially rectangular outline, where the two corner regions 301, 302 arranged at a distance from the propeller hub 11 or the stator body 21 are configured to be rounded. A rear subregion 303 projects over the end cap 50 and ends approximately flush with this. On the opposite side (upstream when viewed in the axial direction), the leading edge 304 of the rotor fin 30 is located almost directly downstream of the trailing edge 204 of the stator fin. That is the stator fins 20 and the rotor fins 30 follow immediately behind one another in the axial direction. Likewise the stator fins 20 are only disposed at an extremely short distance from the propeller 10.

Figure 5:
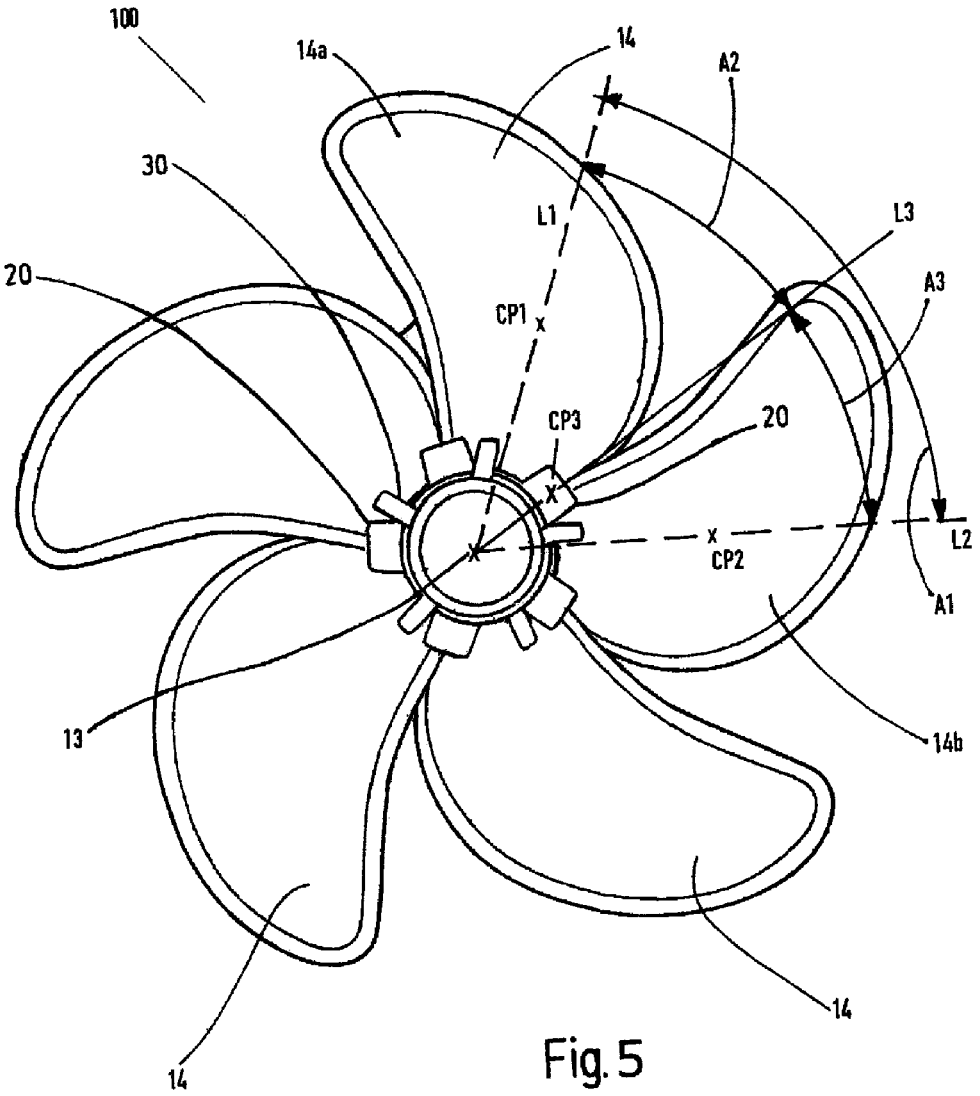
FIG. 5 shows a frontal view of a propeller arrangement with stator fins arranged offset to the propeller blades.

FIG. 5 shows a frontal view of a propeller arrangement 100 according to the invention with stator fins 20 arranged offset to the propeller blades 14. When viewed in the circumferential direction, the stator fins 20 are disposed approximately centrally between two propeller blades 14, that is the stator fins 20, when viewed in the circumferential direction, are located on the distance from one propeller blade 14 to the next propeller blade 14. The distance from one propeller blade 14 to the other is measured in the circumferential direction from a propeller blade central point CP1 of a first propeller blade 14*a* to a propeller blade central point CP2 of a second propeller blade 14*b*. A stator fin 20 is disposed between two propeller blades 14*a*, 14*b* when a central point CP3 of the stator fin 20 is arranged on the circumferential distance (or on a line concentric and parallel to the circumferential distance) between the first propeller blade central point CP1 and the second propeller blade central point CP2. In general, the central points CP1, CP2, CP3 can be defined as the geometric centers of the area covered by a propeller blade 14 or stator fin 20, when viewed in the direction of the propeller axis 13. However, the central point may also be defined as the center of mass of a propeller blade 14 or stator fin 20. Other definitions are possible as well. Accordingly, when imagining a first line L1 through the propeller axis 13 and the first propeller blade central point CP1, a second line L2 through the propeller axis 13 and the second propeller blade central point CP2, and a third line L3 through the propeller axis 13 and the stator fin central point CP3, wherein the lines L1, L2, L3 are at a right angle to the propeller axis 13 and extend radially outwards in each case, a first angle A1 enclosed between the first and second line L1, L2 is divided into two angles, a second angle A2 and a third angle A3, of approximately equal value by the third line L3. Here, approximately equal means that the second angle A2 (or equivalently the complementary angle A3) lies in the range of 25% to 75% of the first angle A1.

In particular, in the views in FIGS. 1 and 2 it can be seen that for the system comprising propeller hub 11, stator body 21, bearing ring 41 and end cap 50, an overall closed, step-free profile is obtained, which in this respect is streamlined.

The invention claimed is:

1. A propeller arrangement for a drive system of a watercraft, comprising: a propeller being rotatable about a propeller axis, wherein at least one rotor fin is provided which is disposed freely rotatably about the propeller axis, wherein the at least one rotor fin is disposed on a propeller hub of the propeller, wherein the diameter of a circular path described by the rotation of the at least one rotor fin is less than the diameter of the propeller, so that the at least one rotor fin substantially exclusively influences a propeller flow in a propeller hub region in such a manner that vortex formation is reduced in the propeller hub region, wherein at least one stator fin co-rotating with the propeller in the same direction is provided, which is disposed between the freely rotatable at least one rotor fin and the propeller, wherein the diameter of a circular path described by a rotation of the at least one stator fin is less than the diameter of the propeller, so that an untwisting of the propeller flow is achieved in the area of the propeller hub region before the flow impinges upon the rotor fin, and wherein the at least one stator fin is disposed on the propeller hub of the propeller and is firmly connected to said hub.

2. The propeller arrangement according to claim 1, characterised in that the diameter of the circular path of the at least one rotor fin is less than 75% of the diameter of the propeller.

3. The propeller arrangement according to claim 2, characterised in that the diameter of the circular path of the at least one rotor fin is less than 55% of the diameter of the propeller.

4. The propeller arrangement according to claim 3, characterised in that the diameter of the circular path of the at least one rotor fin is less than 35% of the diameter of the propeller.

5. The propeller arrangement according to claim 4, characterised in that the diameter of the circular path of the at least one rotor fin is less than 25% of the diameter of the propeller.

6. The propeller arrangement according to claim 1, characterized in that the at least one stator fin is arranged offset in a axial direction with respect to the propeller blades of the propeller.

7. The propeller arrangement according to claim 1, characterised in that a number of rotor fins or stator fins are provided, which are arranged distributed in the circumferential direction about the propeller axis.

8. The propeller arrangement according to claim 7, characterised in that the number of rotor fins or stator fins corresponds to the number of propeller blades of the propeller.

9. The propeller arrangement according to claim 1, characterised in that the at least one rotor fin or the at least one stator fin has an angle of attack with respect to the propeller axis, wherein the angle of attack is 10° to 80°.

10. The propeller arrangement according to claim 9, wherein the angle of attack is 25° to 70°.

11. The propeller arrangement according to claim 10, wherein the angle of attack is 40° to 60°.

12. The propeller arrangement according to claim 1, characterised in that the at least one rotor fin or the at least one stator fin is disposed radially relative to the propeller axis.

13. The propeller arrangement according to claim 1, characterised in that the at least one stator fin is disposed on a stator body, wherein the stator body is disposed on a front end side on a propeller hub of the propeller and is firmly connected to the propeller hub.

14. The propeller arrangement according to claim 1, characterised in that a self-lubricating friction bearing is provided on the propeller hub or on a stator body for mounting the at least one rotor fin.

15. The propeller arrangement according to claim 14, characterised in that the friction bearing comprises a first bearing element attached firmly to the propeller hub or to the stator body and a second bearing element movable with respect to the first bearing element, wherein the at least one rotor fin is firmly attached to the second bearing element.

16. The propeller arrangement according to claim 1, characterised in that the at least one rotor fin is disposed in the direction of the propeller axis at a distance of a maximum of 0.8 times the propeller diameter.

17. The propeller arrangement according to claim 16, characterised in that the at least one rotor fin is disposed in the direction of the propeller axis a distance of a maximum of 0.5 times the propeller diameter.

18. The propeller arrangement according to claim 17, characterised in that the at least one rotor fin is disposed in the direction of the propeller axis a distance of a maximum of 0.3 times the propeller diameter.

19. The propeller arrangement according to claim 1, characterised in that the diameter of the circular path of the at least one stator fin is less than 75% of the diameter of the propeller.

20. The propeller arrangement according to claim 19, characterised in that the diameter of the circular path of the at least one stator fin is less than 55% of the diameter of the propeller.

21. The propeller arrangement according to claim 20, characterised in that the diameter of the circular path of the at least one stator fin is less than 35% of the diameter of the propeller.

* * * * *